US005239845A

United States Patent [19]

Luchi

[11] Patent Number: 5,239,845

[45] Date of Patent: Aug. 31, 1993

[54] DEVICE FOR CHANGING AND CONTROLLING THE YARN FEEDS IN A DOUBLE-CYLINDER CIRCULAR KNITTING MACHINE

[75] Inventor: Luciano Luchi, Impruneta, Italy

[73] Assignee: Savio S.p.A., Pordenone, Italy

[21] Appl. No.: 889,595

[22] Filed: May 27, 1992

[30] Foreign Application Priority Data

Jun. 6, 1991 [IT] Italy ..... MI91A001559

[51] Int. Cl.[5] ..... D04B 15/60

[52] U.S. Cl. ..... 66/140 S; 66/133

[58] Field of Search ..... 66/133, 140 S, 14

[56] References Cited

U.S. PATENT DOCUMENTS

| | | | |
|---|---|---|---|
| 3,359,759 | 12/1967 | Mattingly et al. | 66/133 |
| 3,557,578 | 1/1971 | Fetzer | 66/140 S |
| 3,714,799 | 2/1973 | Minton | 66/140 S |
| 3,881,327 | 5/1975 | Mahler | 66/140 S X |
| 3,949,571 | 4/1976 | Hinkle et al. | 66/140 S |
| 3,975,926 | 8/1976 | Tenconi | 66/133 |
| 4,502,299 | 3/1985 | Keel et al. | 66/14 |
| 4,522,042 | 6/1985 | Casstevens et al. | 66/140 S |
| 4,840,046 | 6/1989 | Goller et al. | 66/140 S X |

FOREIGN PATENT DOCUMENTS

| | | |
|---|---|---|
| 0428205 | 5/1991 | European Pat. Off. . |
| 1408700 | 7/1965 | France . |
| 449844 | 4/1968 | Switzerland . |
| 978894 | 12/1964 | United Kingdom . |
| 2155505 | 9/1975 | United Kingdom . |
| 2016530 | 9/1979 | United Kingdom . |
| 2099464 | 12/1982 | United Kingdom . |

*Primary Examiner*—Clifford D. Crowder
*Assistant Examiner*—John J. Calvert
*Attorney, Agent, or Firm*—Robert D. Schaffer

[57] ABSTRACT

A device for feeding yarn to a circular knitting machine of double-cylinder type with a plurality of yarn guides, and a system for controlling and cutting the yarn ends. The device comprises a suction nozzle in a position external to the cylinders and a rotating cutting member positioned between the nozzle and the cylinder surface and downstream of the nozzle towards the direction of rotation of the needle cylinders.

5 Claims, 8 Drawing Sheets

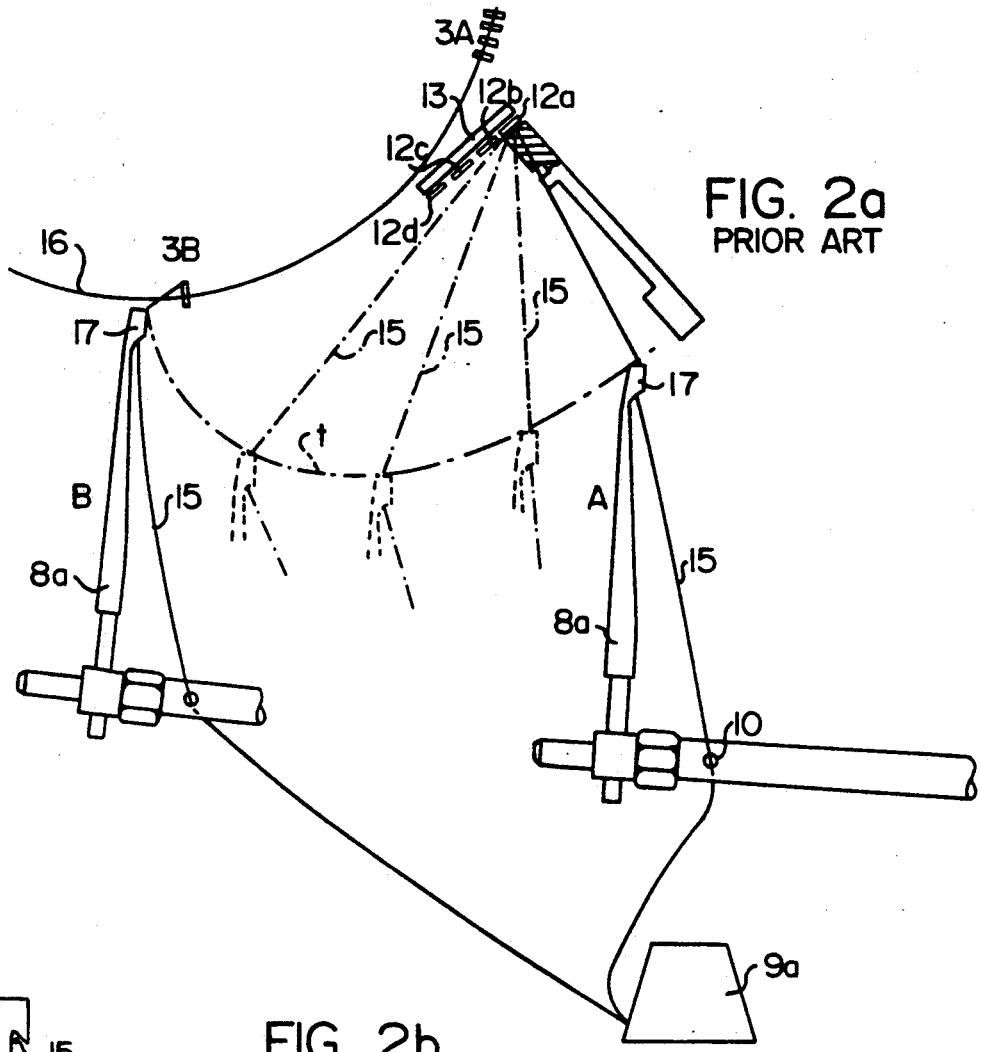
FIG. 2a
PRIOR ART
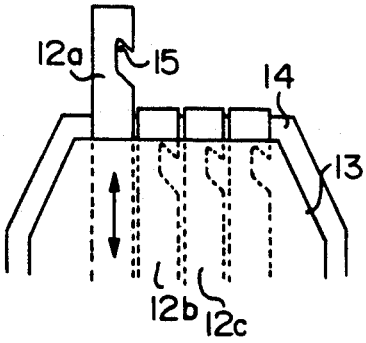
FIG. 2b
PRIOR ART
FIG. 2c
PRIOR ART
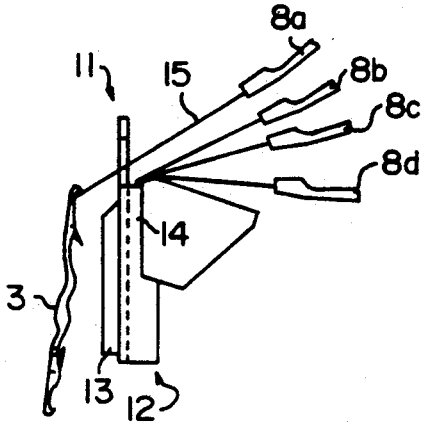

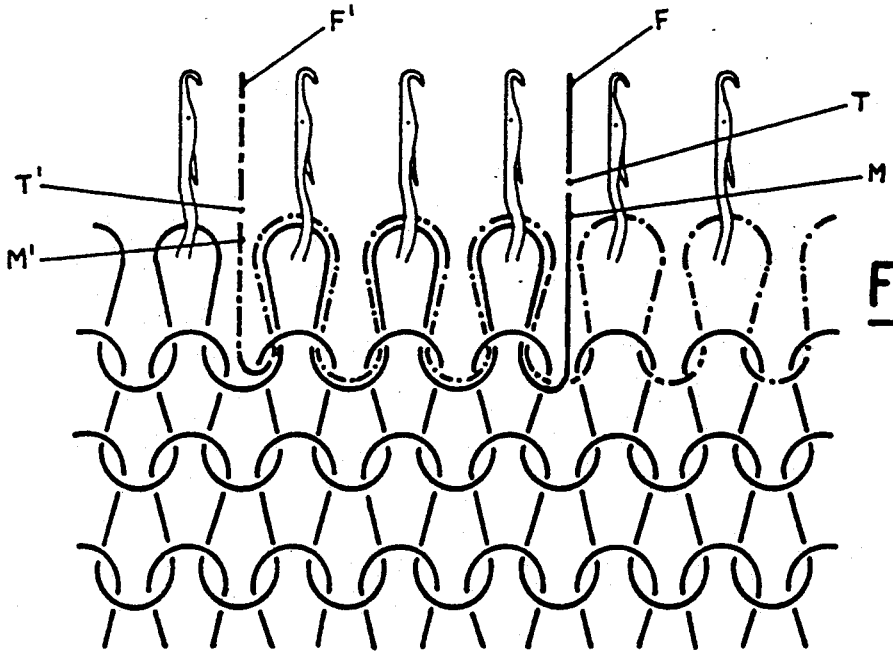
Fig.8
Fig.9
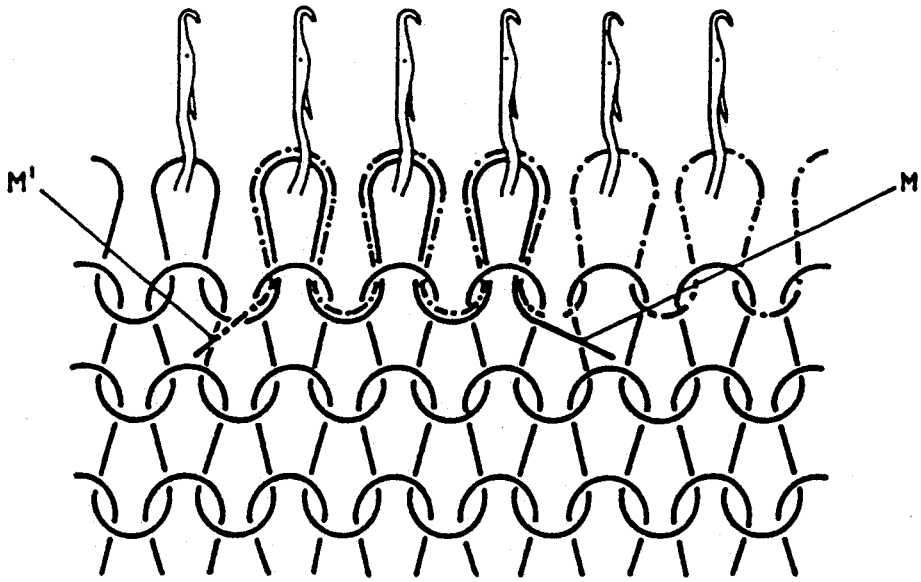

DEVICE FOR CHANGING AND CONTROLLING THE YARN FEEDS IN A DOUBLE-CYLINDER CIRCULAR KNITTING MACHINE

BACKGROUND OF THE INVENTION

1. Field of the Invention

This invention relates to circular knitting machines and in particular the yarn feed to such machines for producing tubular knitted articles such as stockings, and provides a device for presenting the various yarns for forming said articles to the working needle faces in a double-cylinder machine.

2. Description of the Related Art

In general, double-cylinder circular knitted machines consist essentially of two rotating cylinders with tricks in their outer cylindrical surface. The tricks represent the guides for the needles which during their vertical travel form the stitch loops in cooperation with the sinkers.

The two cylinders are positioned one above the other with their two ends facing so that the tricks of the two cylinders correspond axially, in order that the needle of each trick can switch between the two cylinders or faces and engage alternately with one and the other of two identical sliders which slide in the two facing tricks. The two sliders operate alternately, in the sense that a slider operates on receiving the needle from the opposite face and does not operate after consigning the needle to the slider of the other face, which is operating.

The basic stitch forming process will now be described with reference to FIGS. 1 and 2.

The two cylinders are indicated by 1A and 1B and their tricks by 2. The number of tricks is equal to the number of needles 3 which slide within them with vertical reciprocating motion, switching between the two cylinders. For stocking production each cylinder comprises up to about 400 tricks.

In double-cylinder machines the needles are of a special type to be able to switch between the two faces, and are in the form of double-hook needles, with each of which there correspond two sliders disposed in the facing grooves and driven by butts which engage raising and lowering cams controlling the vertical reciprocating motion of the sliders and needles associated with them. A double-hooked needle and slider unit and its operation are described in the European Patent Appln. Public. No. 0 428 205 of the present Applicant.

The needles 3 rotate with the cylinders to operate with reciprocating movement between a minimum travel and a maximum travel position within their cylinder, with the possibility of intermediate positions, by the action of a series of raising cams 4A/B and lowering cams 5A/B, the contours of which engage the butt of the slider 6A/B, causing it to move axially upwards and downwards. The needles cooperate with sinkers 7 arranged in a ring between one needle and the next to form the stitch loops, which when connected together form the tubular fabric. Generally the sinkers 7 undergo small movements to regulate the knit, i.e. the length of yarn between the needle and sinker, which determines the size of the stitch loops.

The cylinders 1 are rotated and with them there rotate the needles 3 and sinkers 7.

During their vertical reciprocating movement the needles are fed in fixed angular positions and at the most advanced levels of the travel within their cylinder 1 by feed stations which, when required, present the needles with the yarn to be knitted into the knitwork at that knitting course and in that angular position. At each feed change the previously fed yarn has to be changed over with the yarn forming the new feed. FIGS. 2*a* and 2*b* show the method of changing the yarn in a conventional feed station. Each feed yarn is carried by a yarn guide 8 which withdraws the yarn from a bobbin 9 via a series of deviators, of which only the deviator 10 located on the shaft of the yarn guide 8 is shown. With the assembly of yarn guides 8 there is associated an assembly 11 of grippers for cutting and controlling the ends of the feed yarns. The number of grippers is equal to the number of yarn guides, four in the illustrated embodiment (8*a* . . . 8D which withdraw yarn from the respective bobbin 9*a* . . . 9*d*), each operating on the feed yarn of one yarn guide and cooperating synchronously with it.

The various yarn guides 8 are positioned at different levels and/or radial distances so that the trajectories t through which they travel do not interfere with each other and so that any one yarn guide can convey its own yarn into operation without it preventing another yarn guide from conveying its yarn out of operation.

The yarn guides are generally driven to extend and retract along their trajectories t to convey the various feed yarns into and out of operation by systems of known type, consisting for example of rotating cams which operate reciprocating levers. The rotation of said cams is generally determined by pneumatic or magnetic controls which engage the cams at the appropriate time with the needle cylinder drive system, to derive their motion from it. A magnetic control system independent of the yarn guide movement is the subject of the copending Italian patent application No. 21040 A/90 in the name of the present applicant.

Each gripper consists of a hook 12 contained between a fixed blade 13 and a part 14 which rises and descends relative to these two. The blade 13 has a cutting edge and cuts the yarn 15 on the fabric side, the yarn making contact with it when the hook 12 which has gripped the yarn is lowered. The part 14 has bevelled edges and grips the residual yarn end on the bobbin side, so that this yarn end is held by the gripper 11 and yarn guide 8 in a defined position.

The conventional yarn changing process using the device of FIGS. 2*a* and 2*b* is as follows:

- the non-operating yarn, shown by full lines, is retained by the gripper hook 12*a*and by the yarn guide 8*a* in position A, as shown in FIG. 2*b* for the yarn guides 8*b*, 8*c* and 8*d*. The machine is operating with other yarn,
- the yarn has now to be brought into operation. The yarn guide 8*a* is moved gradually towards position B along the trajectory t, the yarn assuming the configuration shown by dashed and dotted lines,
- the yarn is transferred into operation. When the yarn guide is in position B the yarn 15 intersects the circular path 16 of the needles 3 and is gripped by the needles 3B, which rise in that angular position following the final position B. A very short time (for example 5–10 needle steps) after the yarn guide 8*a* has reached position B, the hook 12*a* corresponding to the yarn guide 8*a* rises to release the yarn end retained against the bevelled part 14 and is then lowered so as not to hinder other yarns which are to be moved into the non-operating position. The yarn guide 8*a* remains in position B for the entire time during which this yarn is to be fed to the needles, the yarn 15, shown by continuous lines, being dragged into operation by the needles and being unwound from the bobbin 9*a* via the deviators and the yarn guide ring 17, the yarn is now taken out of operation. The yarn guide 8*a* is retracted from position B to position A and the hook 12*a* raised to its maximum level to interfere with the yarn which is taut between the needles in position 3A and the yarn guide in position A, as shown in FIG. 2*b*. A very short time (for example 5–10 needle steps) after the yarn guide has reached position A, the hook 12*a* is lowered and cuts the yarn with the cutter 13, leaving the downstream end attached to the fabric and retaining the upstream end gripped between the lowered hook 12 and the bevelled part 14. The commands for each yarn guide 8 and the corresponding hook 12 are provided by cam devices which provide the necessary synchronization between the hook and the yarn guide, which operate as a pair. The conventional device described up to this point has considerable drawbacks, of which the following should be mentioned.

The hook 12 which rises in phase with the release of the end of the yarn which is entering into operation can interfere with another yarn which is being taken out of operation and which could be gripped in a position which is not its own, so mixing the pairs of yarn guides and hooks and losing the necessary synchronization between the two members. With high-speed machines and frequent yarn changes while working, this problem could result in whole batches of defective stockings, unless the speed is reduced, with resultant reduction of machine productivity.

If two yarn guides are required to take their yarn simultaneously out of operation, the two yarns would both be transferred to the first raised gripper, hence producing the aforesaid defect. Their take-out from operation must be done at different times, thus imposing textile limitations on the machine.

Wool or other voluminous yarns soil the device 11 with the fibres which are inevitably lost during cutting with the blade 13 and the clamping with the part 14. The unit is generally equipped for cleaning by air blasts at every opening at maximum level, but this is not sufficient and the unit 11 has to be periodically dismantled completely and cleaned. The cutting edge of the blade 13 also requires frequent sharpening. The yarn end left upstream on the fabric is very long and has to be cut off during subsequent finishing of the product stocking.

If operating with two yarns of different count in the same yarn guide, for example in "vanise" production, the thicker yarn is gripped whereas the thinner yarn can escape the gripping. This loss of the yarn end means that the stocking is inevitably rejected during quality control.

SUMMARY OF THE INVENTION

The present invention is generally directed to a device for feeding yarn to a rotating circular knitting machine having a plurality of yarn guides for conveying yarn and a plurality of needles for seizing the yarn and for moving in a path. The yarn guides are adapted for moving from an inoperative position distant from the needles to an operative position proximate the needles. The device comprises a cutting control means positioned proximate the needle path. The cutting control means comprises a suction nozzle positioned proximate the needle path for receiving ends of the yarn from the yarn guides when the yarn guides are in the inoperative position. The cutting control means also comprises a cutting member positioned between the nozzle and the needle path and downstream of the nozzle towards the rotational direction of the knitting machine for cutting the yarn ends when the yarn guides move into the inoperative position.

DESCRIPTION OF THE DRAWINGS

A specific embodiment of the present invention will be described with reference to the following drawings, wherein:

FIG. 2A is a diagrammatic view of a device known in the prior art for changing the yarn in a conventional feed station;

FIG. 2B is an enlarged diagrammatic view of the gripper hooks shown in FIG. 2A;

FIG. 2C is an enlarged diagrammatic view of the gripper assembly shown in FIG. 2B;

FIG. 8 shows the produced knit as seen from the inside at the yarn guide change;

FIG. 9 illustrates the knit and shows the effect of the short yarn end cut with the device of the present invention.

DESCRIPTION OF THE PREFERRED EMBODIMENT

Figure 1:
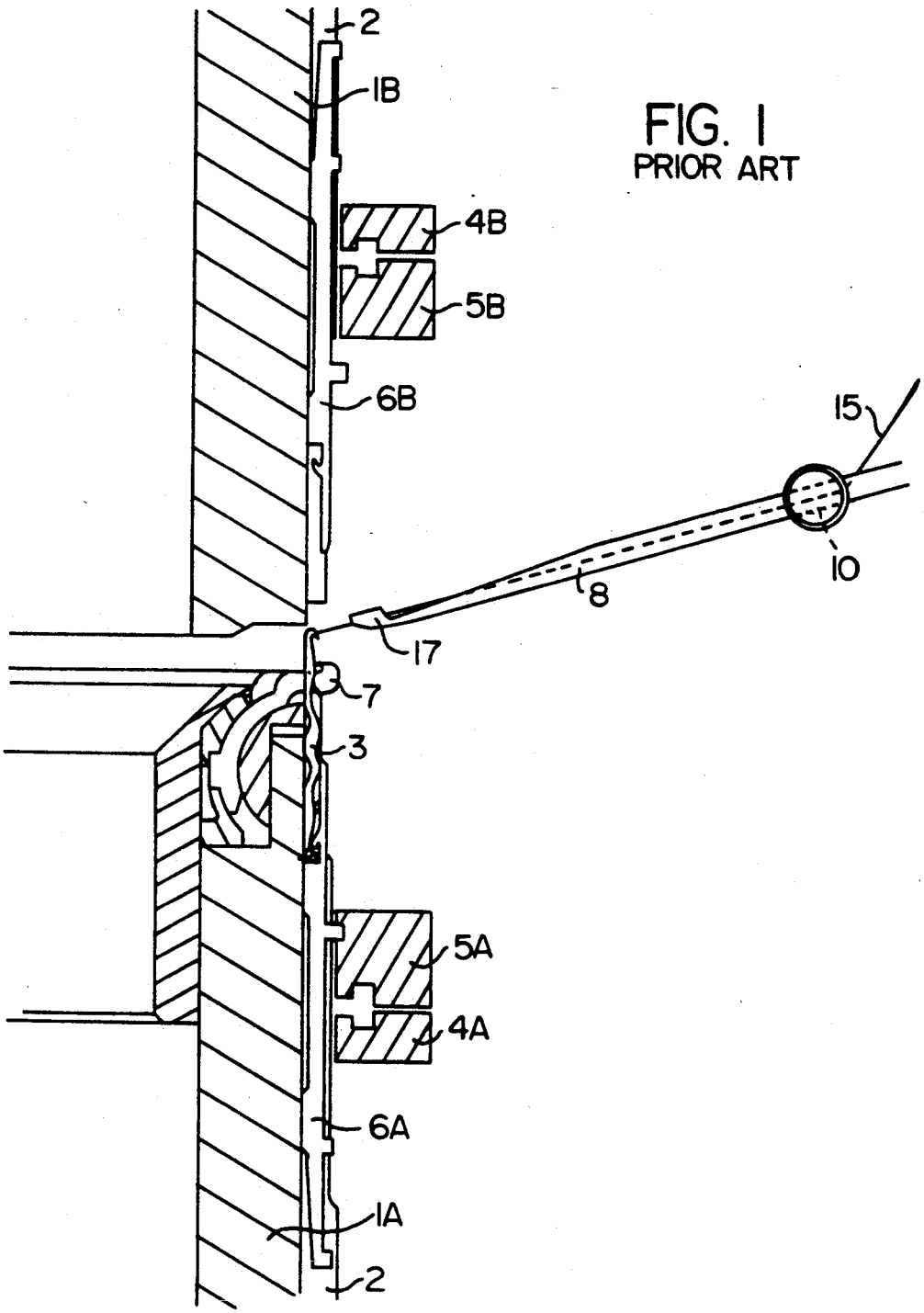
FIG. 1 PRIOR ART
FIG. 1 is a side view of two needle cylinders as known in the prior art.
Figure 3:
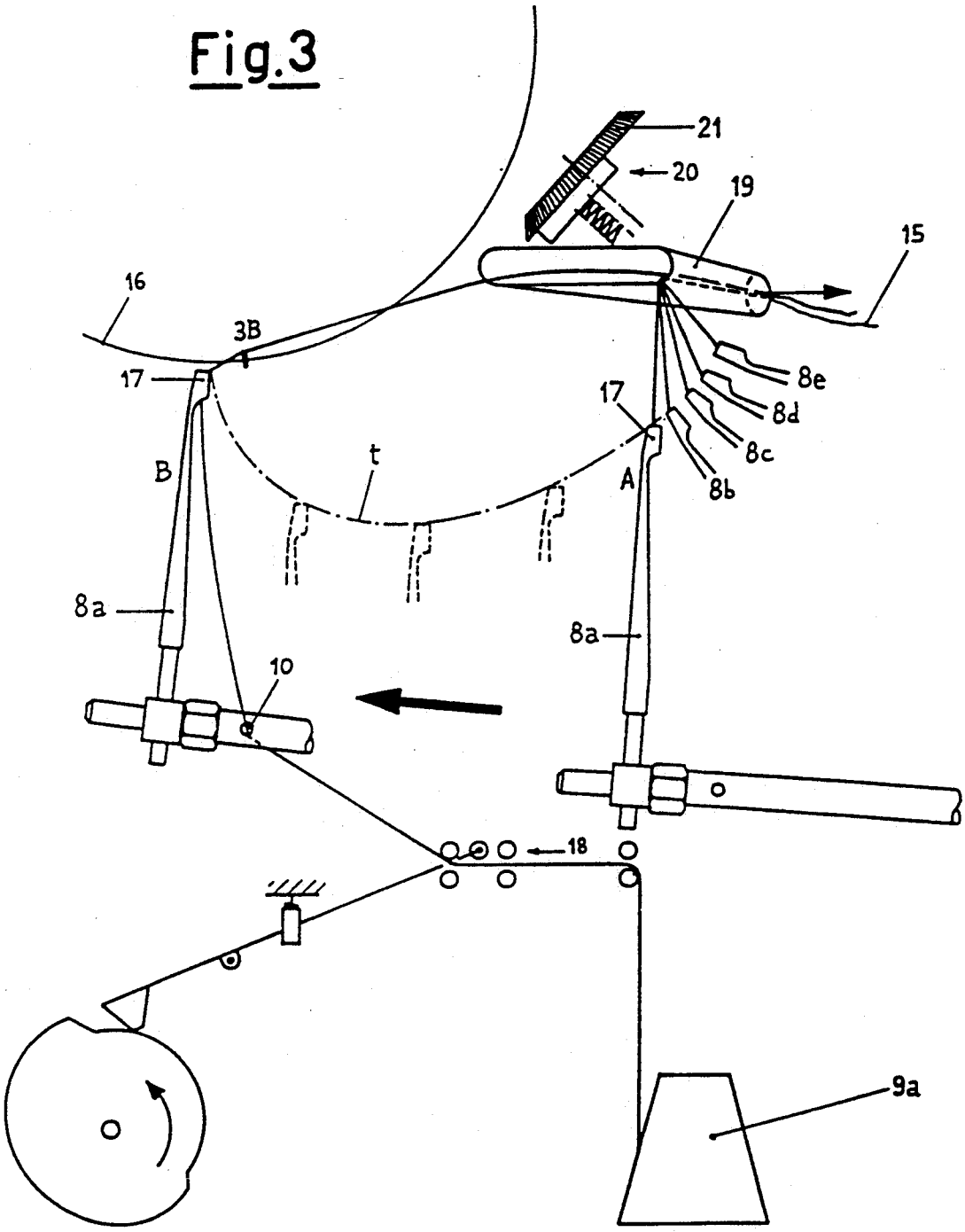
FIG. 3 is a diagrammatic view of the present invention showing the yarn guide moving from an inoperative position to an operative position.

The device of the invention for controlling and cutting the feed yarns to a circular knitting machine is described with reference to FIGS. 3 to 9, which show a typical embodiment thereof by way of non-limiting example, and comprising five yarn guides 8*a* . . . 8*e*. FIG. 3 shows the device for controlling the yarn ends when the yarn is in its out-of-operation position, the yarn guide 8*a* being about to enter operation by passing from position A to position B. The yarn from the bobbin 9 passes in the direction of the thin arrow via the adjustable tensioner 18, the structure and operation of which is described hereinafter, via the deviator 10 and via the yarn guide ring 17 of the yarn guide 8, to a suction nozzle 19 which retains all the ends of the yarns not in operation. According to a preferred embodiment of the invention the suction nozzle 19 is of elongate slot shape, with its major axis at an acute angle to the tangent at the needle cylinder and lying within the circular sector in which the cutting action takes place, with one end in proximity to the path of the needles, for example as in FIG. 3. This arrangement ensures that the yarn ends upstream and downstream of the produced fabric portion are controlled, whatever yarn guide is involved, and that these yarn ends have a very short length.

Figure 4:
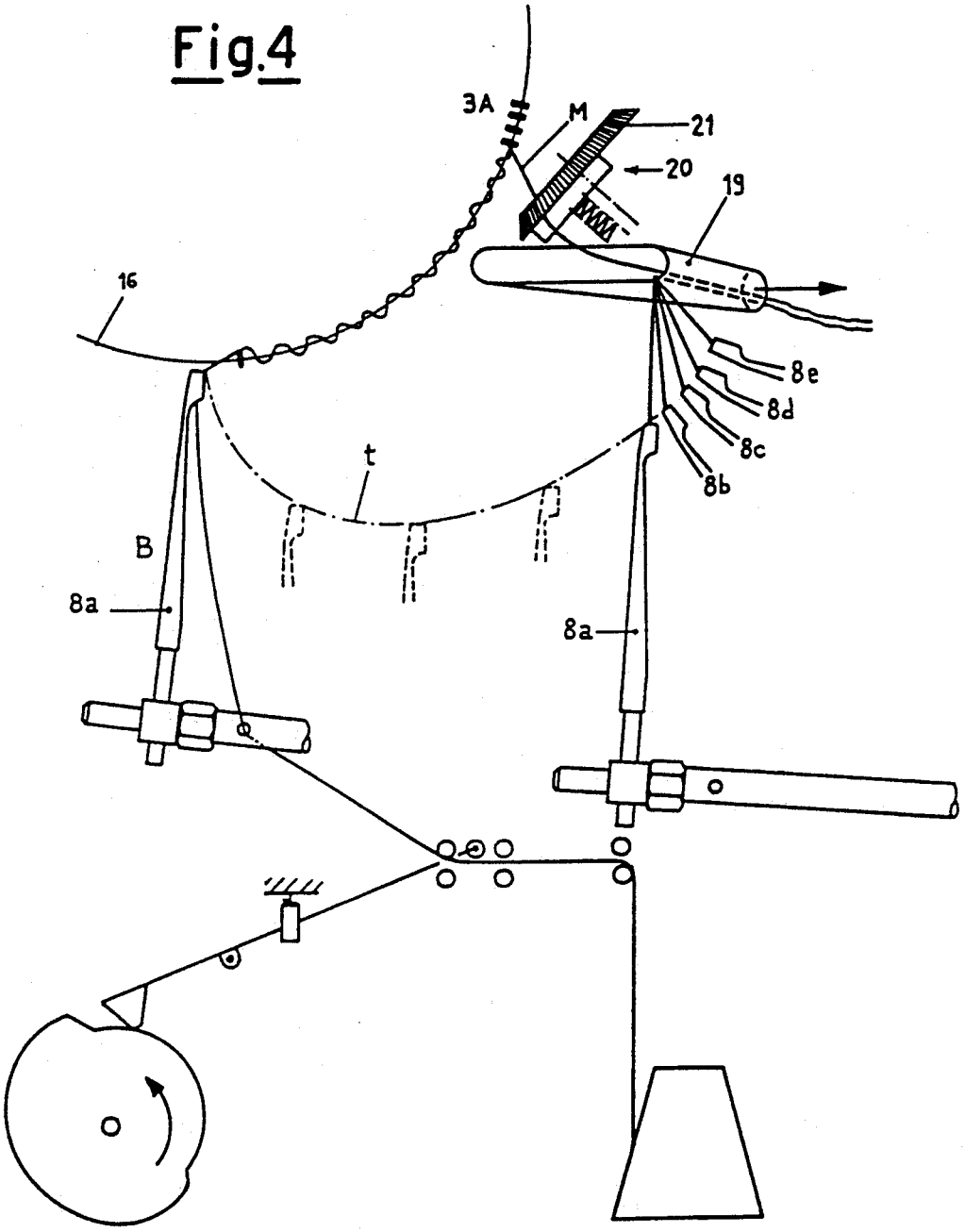
FIG. 4 is a diagrammatic view of the present invention showing the yarn drawn from the yarn guide into the needle path.

The yarn is moved into operation in position B shown in FIG. 4, the yarn guide 8a moving in the direction of the heavy arrow. The yarn end is taut between the ring 17 and nozzle 19 and is made to intersect the path of the needles 16, to be seized in position 3B by the needles 16, which move anticlockwise. The seizing of the yarn is facilitated in known manner by a blowing nozzle located in proximity to position B, which forces the yarn between the yarn guide 17 and nozzle 19 to intersect the path of the raised needles.

The bobbin 9 releases yarn and the needles carry the yarn from position 3B to position 3A with the upstream yarn end always held by the nozzle 19. The yarn end held by the nozzle is drawn by the needles towards the cutting member 20, the upstream yarn end M attached to the hose under production then being cut off. In a preferred embodiment of the invention the cutting member 20 is positioned in proximity to the path 16 and immediately downstream of the nozzle 19 in the direction of rotation of the needle cylinder. It consists of circular rotating blade 21 which is toothed so as not to require periodic sharpening. The yarn end upstream of the member 20 is cut so that the end attached to the fabric is very short.

Figure 5:
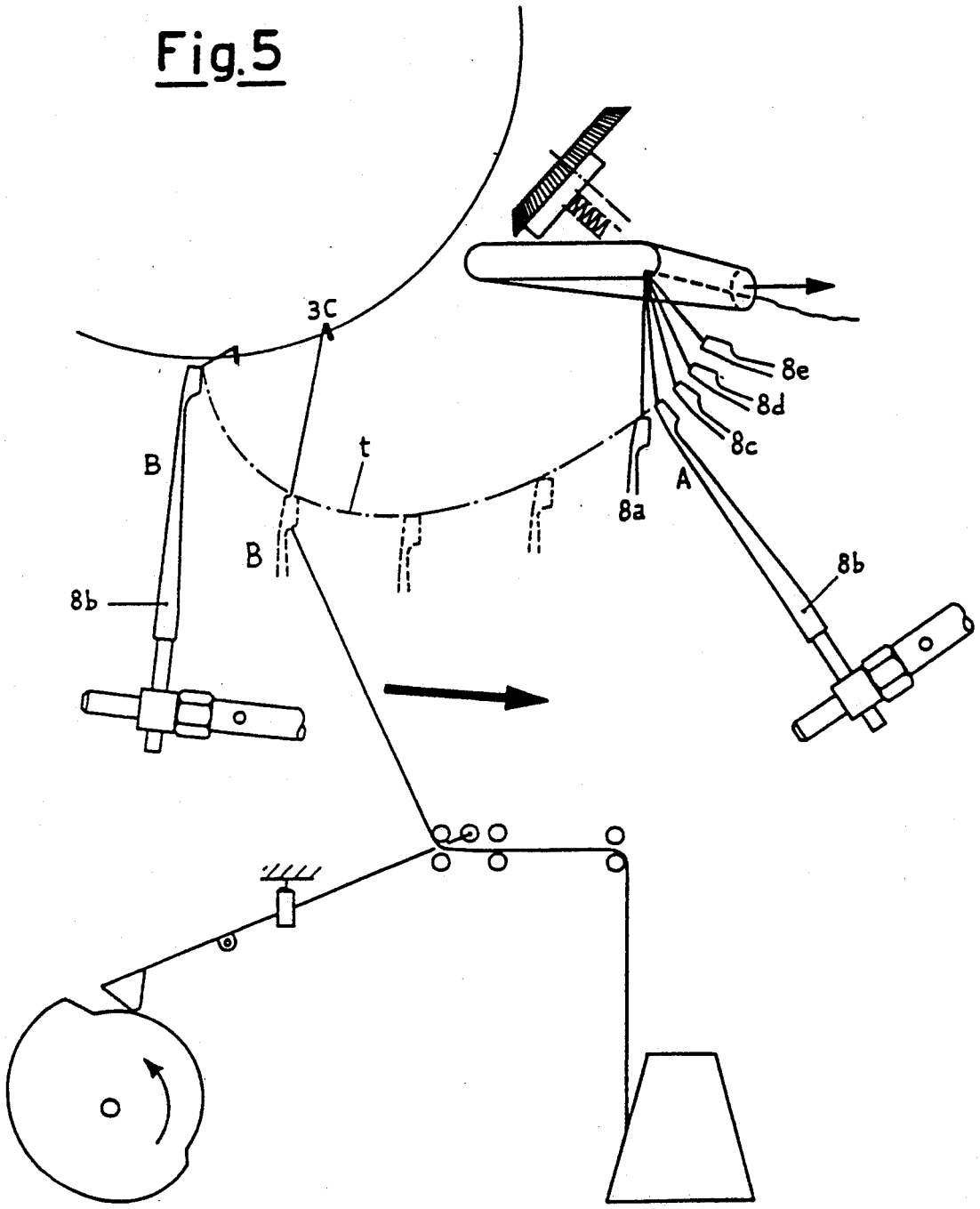
FIG. 5 is a diagrammatic view of the present invention showing the yarn guide change.
Figure 6:
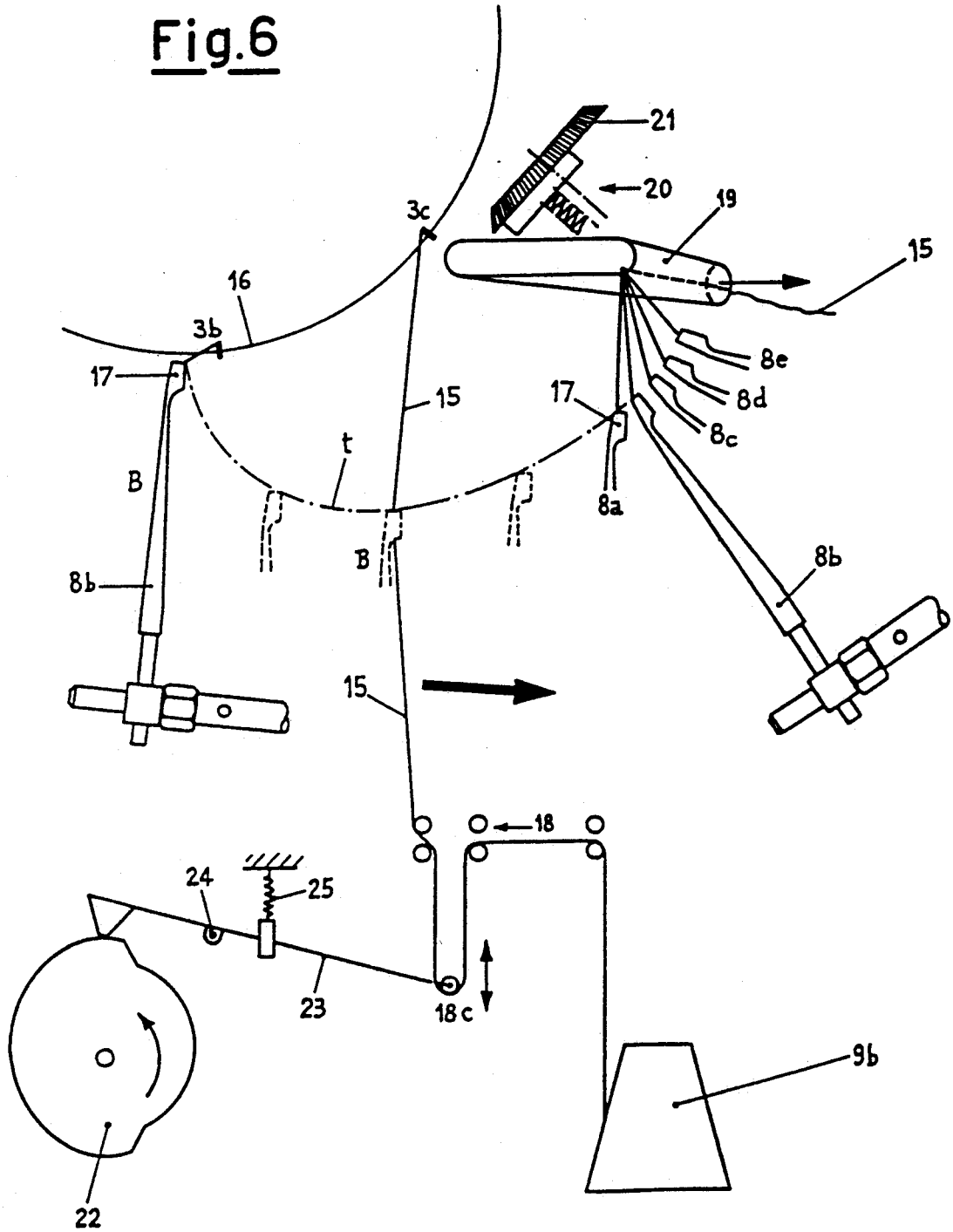
FIG. 6 is a diagrammatic view of the present invention showing the movement of the central extendable deviator during a yarn guide change.
Figure 7:
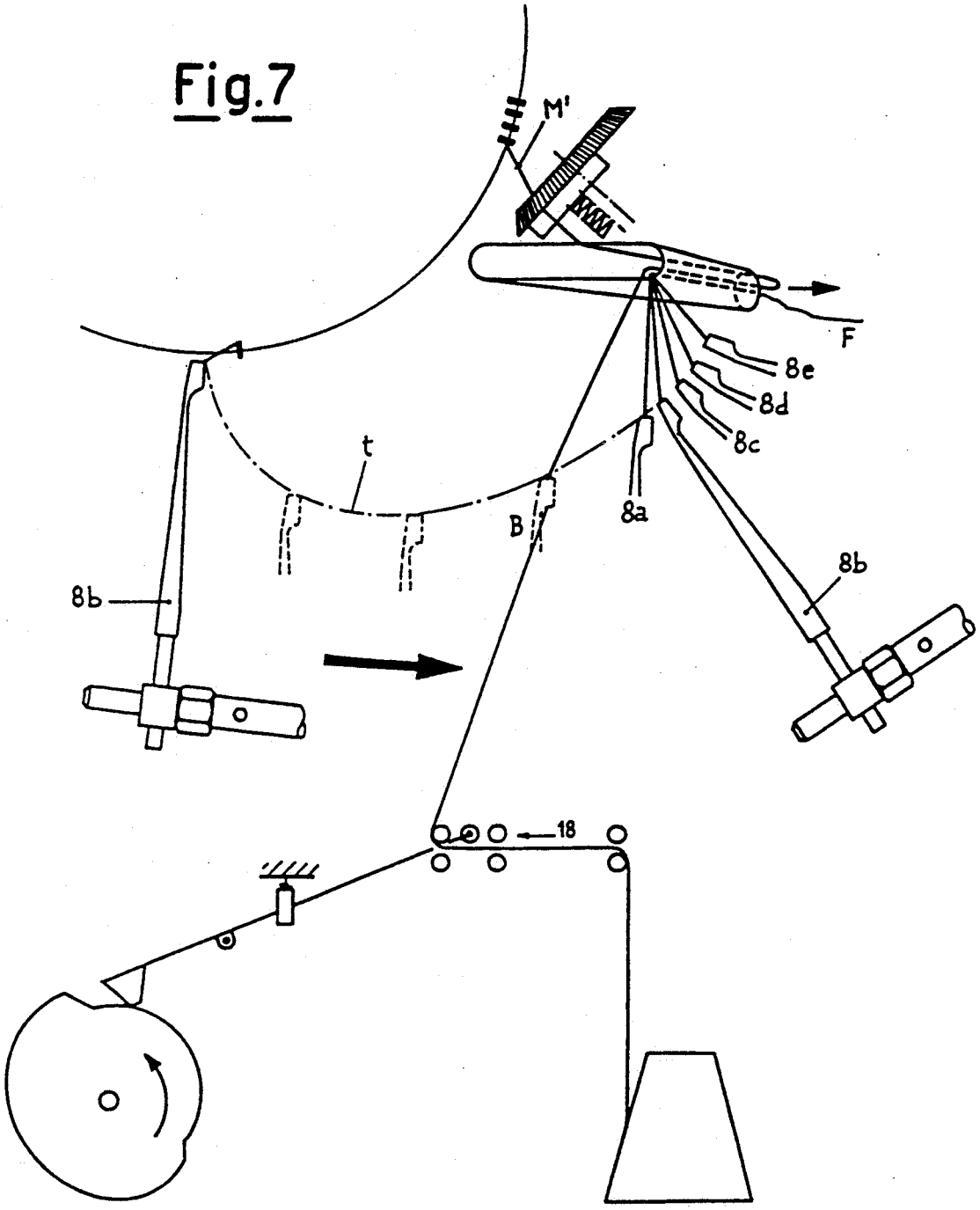
FIG. 7 is a diagrammatic view of the present invention showing the nozzle gripping the yarn accumulated as shown in FIG. 6.

FIGS. 5 to 7 show a yarn guide change. The yarn in operation is initially in the same configuration as the device in position B of the preceding figures, the yarn being unwound from the bobbin by the pull of the yarn guide ring 17 of the yarn guide 8. When the feed yarn, for example of the yarn guide 8b in FIGS. 5 to 7, is to be taken out of operation after being replaced by another yarn (at least one yarn must always be under feed during production, because without yarn no fabric would be produced and a hole would result), this yarn guide is returned to position A in the direction of the heavy arrow of FIG. 5, by the ring 17 undergoing the trajectory t. The yarn is always gripped by the needles 3C which have been the last to receive it, and the downstream yarn end at the fabric is moved to the cutting member 20.

The device according to the invention comprises a plurality of yarn tensioning devices 18 positioned along the yarn path between the bobbins 9 and yarn guides 8, one for each yarn.

As shown in FIG. 6, during the return of the yarn guide 8b to position A, for example at the centre of the path from B to A, a synchronized command, for example by a rotating cam 22 which coordinates the movements of the yarn tensioner 18 and the yarn guide 8, moves the central extendable deviator 18c of the yarn tensioner 18 outwards, preferably gradually, in the direction shown by the double arrow to take up from the bobbin 9b a reserve of yarn to ensure its seizure by the nozzle. The rotary cam 22 operates the deviator 18c by a lever 23 pivoted about a fulcrum 24 and provided with a return spring 25 which causes the deviator 18c to return to an aligned position preferably at a fast speed as soon as the contour of the cam 22 ceases its extension action. Before the combined action of the returning yarn guide 8b and the last needles to have taken up the yarn brings the yarn into contact with the rotating blade 21, the deviator 18c is made to return by the cam 22 and spring 25 to its rest position. In this manner, on cutting the downstream yarn end M', the yarn reserve accumulated by the yarn tensioner 18 is already available in the nozzle 19, to hence allow it to effectively grip and reliably control the end F attached to the bobbin after cutting the yarn. In the embodiment of FIG. 7 it can be seen that the accumulation device 18 for the yarn reserve, after serving the yarn guide, gives up the accumulated part of the yarn 15 to the nozzle 19 an instant before the yarn is cut, so ensuring a sufficiently long portion of yarn within the nozzle to enable it to be retained during the next entry into operation, in the manner shown in FIG. 3.

FIG. 8 shows the produced knit seen from the inside at the yarn guide change, where T—T' is the cut region, M—M' are the yarn ends attached to the fabric, and F—F' are the yarn ends of the feed bobbin. FIG. 9 shows the effect of the short yarn end cut with the device of the invention. The ends M—M' lie within the fabric, resulting in a better quality of the knitwork produced.

It is immediately apparent that the device of the invention overcomes all the state drawbacks of the method of the known art. Any yarn can be put into operation without interfering with the removal from operation of another yarn by its yarn guide. Several yarns can be taken out of operation simultaneously by different yarn guides. The upstream and downstream yarn ends on the fabric are very short and do not require stocking finishing operations. The nozzle 19 seizes yarns of different count without distinction, and the cutting member 20 remains efficient and does not require maintenance. The yarn end cutting and control device is always clean by virtue of the constant action of the nozzle 19.

I claim:

1. A rotating double cylinder circular knitting machine having a device for feeding yarns to the knitting machine, a plurality of needles for seizing the yarn and for moving in a path, wherein the device comprises:
   - a plurality of yarn guides for conveying the yarn and movable from an inoperative position distant from the needles to an operative position proximate the needles;
   - a cutting control means positioned proximate the needle path, comprising:
     - a) a suction nozzle positioned outside and proximate the needle path for receiving ends of the yarn from the yarn guides when the yarn guides are in the inoperative position;
     - b) a cutting member positioned between said nozzle and the needle path and downstream of said nozzle towards the rotational direction of the knitting machine for cutting the yarn ends when the yarn guides move into the inoperative position.

2. The device of claim 1, wherein said cutting member comprises a continuously rotating toothed blade.

3. The device of claim 1, further comprising a corresponding plurality of yarn tensioners and bobbins as yarn guides, wherein each of said yarn tensioners has an extendable portion for drawing a reserve of yarn from said bobbins and for releasing said yarn reserve to said nozzle so that said nozzle retains said yarn reserve when said cutting member cuts the yarn end.

4. The device of claim 3, wherein said extendable portion comprises control means for synchronizing movement between said extendable portion and a corresponding yarn guide for drawing said yarn reserve from said bobbin when said corresponding yarn guide moves toward the inoperative position and for bringing the yarn end toward said nozzle when said cutting member cuts the yarn end so that said nozzle retains said yarn reserve and said cut yarn end therein.

5. The device of claim 1, wherein said nozzle has a major axis with an elongate slot therein forming an acute angel proximate to the needle path and tangent to the needle cylinder.

* * * * *